US005137768A

United States Patent [19]

Lin

[11] Patent Number: 5,137,768

[45] Date of Patent: Aug. 11, 1992

[54] HIGH SHEAR MODULUS ARAMID HONEYCOMB

[75] Inventor: Pui-Yan Lin, Hockessin, Del.

[73] Assignee: E. I. Du Pont de Nemours and Company, Wilmington, Del.

[21] Appl. No.: 552,553

[22] Filed: Jul. 16, 1990

[51] Int. Cl.[5] ..... B32B 3/12

[52] U.S. Cl. ..... 428/116; 52/806; 162/157.3; 428/118; 428/902; 493/966

[58] Field of Search ..... 428/116, 118, 902; 52/806; 162/157.3; 493/966

[56] References Cited

U.S. PATENT DOCUMENTS

| | | | |
|---|---|---|---|
| 3,756,908 | 9/1973 | Gross | 162/146 |
| 3,767,756 | 10/1973 | Blades | 264/184 |
| 3,869,430 | 3/1975 | Blades | 264/184 X |
| 4,052,523 | 10/1977 | Rhodes et al. | 428/116 |
| 4,623,951 | 11/1986 | DuPont et al. | 428/116 X |
| 4,710,432 | 12/1987 | Nishimura et al. | 428/542.8 |
| 4,729,921 | 3/1988 | Tokarsky | 428/288 |
| 4,836,507 | 6/1989 | Yang | 264/143 |

FOREIGN PATENT DOCUMENTS

| | | |
|---|---|---|
| 60-36152 | 2/1985 | Japan . |
| 62-223398 | 10/1987 | Japan . |

OTHER PUBLICATIONS

Research Disclosure No. 18823, Dec. 1979.

Product brochure HRH-49 "Honeycomb of Kevlar! 49—Data Sheet 1300".

Product brochure TSB 120 "Mechanical Properties of Hexcel Honeycomb Materials".

*Primary Examiner*—Henry F. Epstein

[57] ABSTRACT

A light weight honeycomb structure is disclosed made from aramid fibers and exhibiting extremely high shear modulus.

11 Claims, 1 Drawing Sheet

FIGURE
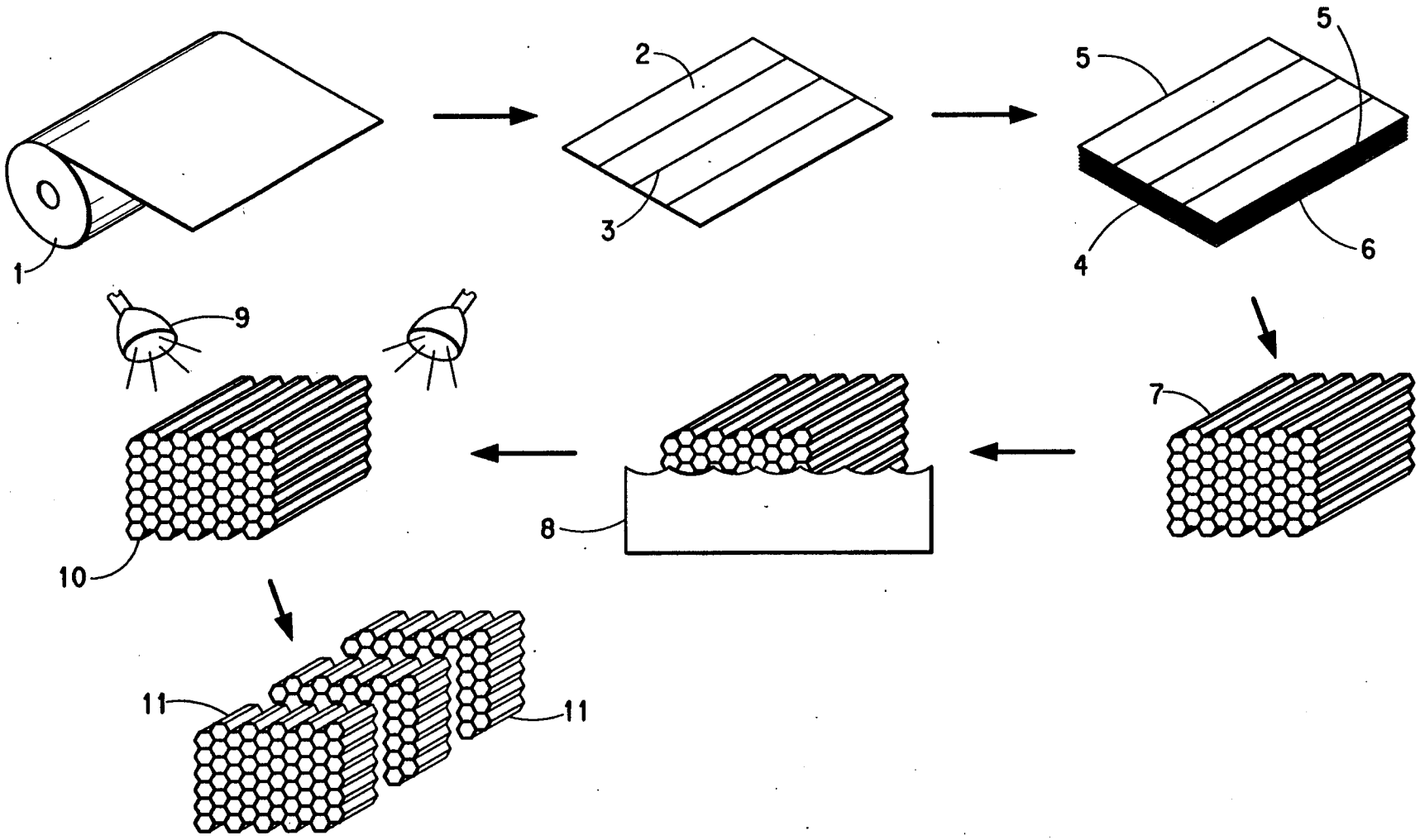

HIGH SHEAR MODULUS ARAMID HONEYCOMB

BACKGROUND OF THE INVENTION

1. Field of the Invention

This invention relates to a honeycomb structure comprising a paper or structural sheet of aramid materials impregnated by a solid matrix resin wherein the honeycomb exhibits a light weight, a high shear strength-/modulus, an excellent stability to moisture and high temperature, and excellent corrosion resistance, toughness, and fatigue performance.

2. Description of the Prior Art

U.S. Pat. No. 4,710,432 issued Dec. 1, 1987 on the application of Nishimura et al., discloses preparation of a polyester paper comprising drawn and flattened polyester fibers. The paper is used to make honeycomb. Honeycomb made from paper comprising fibers of poly(m-phenylene isophthalamide) is mentioned as being in the prior art.

Japanese Kokai Publication 60-36152, published Feb. 25, 1985 on the application of Yamamoto et al., discloses a two-component, nonwoven, aramid paper for use in the manufacture of honeycomb. One of the paper components is a drawn fiber and the other is a non-drawn fiber. There are no binder fibers in the construction.

Japanese Kokai Publication 62-223398, published Oct. 1, 1987 on the application of Nishimura et al., discloses a two-component, nonwoven, paper wherein one of the components is a strong fiber which can be aramid, and the other component is a polyester fiber of low orientation. The paper can be used for honeycomb.

U.S. Pat. No. 4,729,921, issued Mar. 8, 1988 on the application of Tokarsky, discloses preparation of aramid papers using aramid floc, aramid fibrids, and, optionally, aramid pulp. The papers are said to be useful for laminating printed circuit boards.

SUMMARY OF THE INVENTION

The present invention provides a honeycomb structure comprising a core impregnated by a solid matrix resin wherein the core comprises a nonwoven paper including a uniform mixture of 0 to 50, weight, percent of a polymeric binder material, 50 to 100, weight, percent para-aramid fibers, and a solid matrix resin uniformly distributed throughout the paper such that the para-aramid fibers represent 20 to 80% of the total volume of the impregnated core material, wherein the core exhibits a density of 0.015 to 0.24 g/cc and a shear modulus of greater than 1000 kg/cm$^2$.

The present invention more particularly provides a honeycomb structure comprising a core impregnated by a solid matrix resin wherein the core comprises a nonwoven paper including a uniform mixture of 0 to 50, weight, percent poly(m-phenylene isophthalamide) (MPD-I) fibrids, 50 to 100, weight, percent poly(p-phenylene terephthalamide) (PPD-T) fibers, and a solid matrix resin uniformly distributed throughout the paper such that the para-aramid fibers represent 20 to 80% of the total volume of the impregnated core material.

The shear modulus of the core of this invention bears the following relationship to the density:

$$\text{Shear Modulus (kg/cm}^2) > 7000 \times \text{core density (g/cm}^3).$$

In a preferred embodiment of a core of this invention with hexagonal cells, the relationship is as follows:

$$\text{Shear Modulus (kg/cm}^2) > 14000 \times \text{core density (g/cm}^3).$$

BRIEF DESCRIPTION OF THE DRAWINGS

The Figure is a schematic depiction of a process for manufacturing the honeycomb of this invention.

DETAILED DESCRIPTION OF THE INVENTION

High performance honeycomb structures are commonly manufactured from aluminum, fiberglass, or synthetic fibers. Aluminum honeycombs exhibit high strength and high shear modulus; but are subject to degradation by corrosion and are electrically conductive. Moreover, aluminum honeycombs exhibit very high coefficients of thermal expansion and are subject to damage during handling.

Fiberglass honeycombs are, generally, made using woven fabrics of glass fibers and are not available in very low densities due to difficulties in producing fine denier woven glass. Honeycomb made from normal woven fiberglass does not exhibit high shear modulus. Honeycomb made from bias woven fiberglass exhibits high shear modulus but is difficult to manufacture, has a high coefficient of thermal expansion, and is subject to damage during handling.

Honeycombs made from woven aramid fabrics are not available in low densities because woven aramid fabrics are not available in low densities. Honeycomb made from woven aramid fabrics does not exhibit high shear modulus.

Up to the present time, the standard for honeycombs made from synthetic fibers has been honeycombs made from poly(m-phenylene terephthalamide) (MPD-I). Papers made using fibrids and short fibers of MPD-I have been described in U.S. Pat. No. 3,756,908, issued Sep. 4, 1973 on the application of Gross; and have been sold for honeycomb manufacture as lightweight, thermally stable products useful in critical construction such as for vehicular structures in transportation, sporting equipment, and temporary shelters. The MPD-I honeycomb exhibits a shear strength and modulus somewhat below honeycombs made from aluminum and bias-woven glass fibers. MPD-I honeycomb shear strength and modulus are comparable with the shear strength and modulus made from normal-woven glass fibers.

The present invention provides honeycomb which is very light weight, very stable to heat and humidity, has a low moisture absorption, is a good electrical insulator with a low dielectric constant, and which exhibits very high shear modulus. Because the honeycomb of this invention is made using nonwoven paper, the honeycomb can be made at a lower density than when using woven materials. The nonwoven paper which is used in the honeycomb of the present invention includes a combination of 0 to 50% binder, preferably MPD-I fibrids, and 50 to 100% para-aramid fibers, preferably PPD-T. The use of nonwoven paper in this invention represents, also, an improvement over the use of woven materials because nonwoven structures can be made with controlled uniformity and can more easily be made to include additives.

Fibrids are nongranular, nonrigid film-like particles and are preferably made from MPD-I. Preparation of fibrids is taught in U.S. Pat. No. 3,756,908 with a general discussion of processes to be found in U.S. Pat. No. 2,999,788. Two of the three fibrid dimensions are on the order of microns and the fibrids should be refined, in accordance with the teachings of U.S. Pat. No. 3,756,908 patent, only to the extent useful to permit permanent densification and saturability of the final sheet.

Fibrids are used as a binder for the para-aramid fibers; and MPD-I fibrids are preferred because they are made from an aramid material exhibiting properties which are desirable for the product of this invention. Fibrids or a binder resin of other material would be acceptable for this invention provided that it, also, exhibited the properties required for the honeycomb product. Other binder materials are in the general form of resins and can be epoxy resins, phenolic resins, polyureas, polyurethanes, melamine formaldehyde resins, polyesters, polyvinyl acetates, polyacrylonitriles, alkyd resins, and the like. Preferred resins are water dispersible and thermosetting. Most preferred are binders consisting of water-dispersible epoxy resins.

Use of binders such as fibrids or binder resins greatly facilitates the handling of the aramid paper during preparation and when the paper is to be continuously impregnated with resin for the preparation of honeycomb. When batch methods of paper preparation are used, the binder may be omitted at the expense of ease of handling. When continuous papermaking processes are used, binder at less than 5%, by weight, of total solids provides inadequate effect and at more than 50%, by weight, of total solids is not generally retained by the fibers. Moreover, if more than about 50, weight, percent of fibrid binder is used, the sheet may become closed and unsaturable. If, due to excess or overlarge fibrids, the binder seals off the interior of the paper so that the matrix resin cannot penetrate to bond all fiber surfaces, the honeycomb cannot develop improved properties. Likewise, if the binder envelops the fiber and forms a barrier between the impregnating resin and the para-aramid fiber, the honeycomb may be weakened. Saturation of the paper by matrix resin is important.

Binder materials can be used to prepare the paper and can then be removed by dissolving or burning them away from the para-aramid fibers prior to impregnating the paper to make the honeycomb. In that way, honeycomb of this invention can be made in which the paper is 100% para-aramid fibers.

Para-aramid fibers are very high in strength and modulus. Examples of para-aramids are set out in U.S. Pat. No. 3,869,429 and in European Patent 330,163. Specific examples of para-aramids are poly(p-phenylene terephthalamide) (PPD-T) and copoly(p-phenylene-3,4'-oxydiphenylene terephthalamide). Fibers of PPD-T are, generally, made by an air gap spinning process such as that described in U.S. Pat. No. 3,767,756; are preferably heat treated as described in U.S. Pat. No. 3,869,430. The fibers used in the honeycomb of this invention are 1 to 25, preferably 2 to 20 mm long and are about 1 to 5 denier. The fibers used in this invention are staple cut from continuous yarn or tow and are combined with the binder to form the paper.

The paper used in making the honeycomb of this invention, must be of high density and must have at least 50%, by weight, para-aramid staple fiber. The paper can be made in accordance with usually accepted papermaking practices. One preferred papermaking method includes the steps of: (1) preparing a 0.01 to 3 percent, by weight, aqueous slurry of aramid staple fibers; (2) optionally, adding a binder at 5 to 50%, by weight, of the total solids; (3) forming a sheet from the slurry using known papermaking methods; (4) drying the thusly formed sheet; and (5) calendering the sheet in one or more steps between rigid rolls heated at 125 to 400° C. at a pressure of about 70 to 3500 kilograms per lineal centimeter. The sheets can, also, be densified using platens with equivalent heat and high pressure.

The density of paper used in this invention equals the density of the para-aramid fibers divided by the weight fraction of the para-aramid fibers in the paper times the: volume fraction of fibers in the paper. In order to yield the honeycomb of this invention, it has been determined that the volume fraction of para-aramid fibers in the paper, in the absence of matrix resin, must be from 0.25 to 0.80.

$$\text{Paper Density} > \frac{\text{para-aramid fiber density}}{\text{wt. fraction para-aramid fiber}} \times 0.25$$

The density of poly(p-phenylene terephthalamide) fibers is about 1.44 g/cc.

Of course, additives which are normally used with papers of this sort can be used with the paper to be made into the honeycomb of this invention, so long as the additives do not detract significantly from the performance demanded in honeycomb use. Oxidation inhibitors, flame retardants, and the like are customarily added to the papers.

Honeycomb is made using layers of paper having alternate layers affixed in parallel lines staggered from lines in adjacent layers. The layers are generally affixed using a resin adhesive. The paper of the honeycomb can be impregnated using a resin characterized as a matrix resin; and matrix resin can be the same resin as is used for a resin adhesive. It is also the case that the same resin which is useful as a binder resin for the paper can be used as matrix resins in manufacture of the honeycomb of this invention. Other resins useful as matrix resins are: thermosetting —phenolic resins, polyimide resins, diallyl phthalate resins, bismaleimide-triazine resins, epoxy resins, and the like. Preferred matrix resins are phenolic resins and epoxy resins. As a general rule, any polymeric material is eligible as a matrix resin if it exhibits a tensile modulus of greater than 24,600 kg/cm$^2$ and has good adhesion to the para-aramid fibers.

For discussion of the manufacture of honeycomb, reference is made to the Figure. A roll of paper 1 can be used as a source of paper for cutting individual sheets 2 and applying stripes of adhesive 3 before laying the sheets together to form a collapsed structure of sheets expandable to form a honeycomb 4. While still in the unexpanded form, the structure 4 is subjected to curing conditions to cure the adhesive strips 3 and adhere the several layers 2 together. The block 4 is then expanded by pulling edges 5 and 6 apart from each other to yield honeycomb 7. Honeycomb 7 is heat set and then dipped in an uncured matrix resin bath 8. The dipped honeycomb with uncured matrix resin is subjected to curing heat 9; and the dipping and curing can be repeated until the desired amount of matrix resin has been accumulated and cured to yield completed honeycomb 10. Completed honeycomb 10 is cut or otherwise shaped into individual honeycomb articles 11.

The honeycomb core of this invention can be made with densities from 0.015 to 0.24 g/cc depending upon the basis weight of the unimpregnated sheet and the amount of matrix resin included in the structure. The shear modulus of honeycomb is a direct function of core density and floc content, with higher densities and higher floc contents yielding higher shear moduli. For honeycomb cores of the present invention, the shear modulus ($kg/cm^2$) is greater than 7000 times the core density ($g/cm^3$) for all cell shapes; and, for hexagonal cell shapes, the shear modulus ($kg/cm^2$) is greater than 14000 times the core density ($g/cm^3$).

The matrix resin can include additives which are usually present in such materials. Additives can be used to control oxidation, promote flame retardance, color the structure, alter the electromagnetic properties of the material, and the like. Test Methods Density. The density of a honeycomb core is determined by weighing a core of known outside dimensions and calculating the density therefrom.

Shear Strength Moduli. Honeycomb core shear moduli and strengths are determined in accordance with United States Military Standard MIL-STD-401B, 5.1.5. Test specimens are 50mm×12.7mm×165mm with the longitudinal axis of the cells parallel with the short dimension. Each test is conducted with two specimens and the results are averaged for reporting purposes. Each test specimen is conditioned for 16 hours at 23° C. in 50% relative humidity. Steel plates 1.27cm thick are adhered to the open cell ends of the specimens using an epoxy resin. The plates are positioned so that testing forces shall pass as closely as possible through diagonally opposite corners of the specimen.

Compression is applied to the plates continuously at a rate such that failure will occur in not less than 3 and not more than 6 minutes to the ends of the steel plates through a universal joint so as to distribute the load uniformly across the width of the specimen and along a line extending from diagonally opposite corners of the specimen. A stress-strain curve is recorded and shear strength and shear modulus are determined. $hear strength is defined as the maximum shear stress developed by the specimen. Shear modulus is $$G = W\frac{t}{ab}$$

where W is the slope of the initial linear portion of the load deflection curve and t, a, and b are the thickness, length, and width, respectively, of the specimen.

For purposes of testing the honeycombs of this invention, the shear modulus identified as "L-shear" is determined. The "L-shear" is determined by mounting the honeycombs such that the longitudinal axis of the continuous sheet in the honeycomb is in the same direction as the testing force application as described in MIL-STD-401B.

DESCRIPTION OF THE PREFERRED EMBODIMENTS

A series of several honeycomb structures was made to demonstrate the improved shear modulus of the honeycomb of the present invention. Papers were made using MPD-I fibrids and PPD-T staple in a variety of ratios and a paper was made using 50, weight, percent, each, of MPD-I fibrids and MPD-I staple for a control comparison.

Unrefined MPD-I fibrids were made as described in U.S. Pat. No. 3,756,908 (Gross) for preparation of fibrids. Fibrids were partially refined by mixing seven hundred milliliters of a 1.2, weight, percent dispersion of the fibrids with 2100 ml of water in a Waring Blendor jar for 60 seconds.

PPD-T staple was made by cutting continuous para-aramid yarn into 0.60–0.65 cm pieces. The para-aramid yarn was a commercial product having a denier of 1.5 and sold under the trade designation Kevlar ® 49 by E. I. du Pont de Nemours & Co.

Handsheets were made as follows: Into 800 ml of water in a Waring Blendor cup were added the staple and the fibrids at weights selected to provide wet-laid sheets of about 54 $g/m^2$ (1.6 $oz/yd^2$). This mixture was blended 30 to 60 seconds. The paper former was an M/K Systems Series 8000 Sheet Former designed to wet-lay 30.5 cm square sheets. The slurry in the Waring Blendor was poured into the tank of the paper former which contained 22 liters of water. Mixing in the tank was for about 30 seconds prior to dewatering on the paper former. Resultant handsheets were partially dried on a drum dryer at 100° C. for about 1 minute and then press-dried using a Noble & Wood Hot Plate Module E9 at 200° C.

Each sheet was compacted, using a two-roll calender with steel rolls at 159 kg/cm and 325° C., to a specific gravity of about 1.06 g/cc. The sheets were dipped in a solution which was 2–5% solids comprising 70 weight parts of an epoxy resin identified as Epon 826 sold by Shell Chemical Co., 30 weight parts of an elastomer-modified epoxy resin identified as Heloxy WC 8006 sold by Wilmington Chemical Corp, Wilmington, DE, USA, 54 weight parts of a bisphenol A - formaldehyde resin curing agent identified as UCAR BRWE 5400 sold by Union Carbide Corp., and 0.6 weight parts of 2-methylimidazole as a curing catalyst, in a glycol ether solvent identified as Dowanol PM sold by The Dow Chemical Company.

Twenty-six of the sheets were printed with epoxy node lines using a solution which was 50% solids comprising the same components in the same amounts as identified in the formulation of the previous paragraph in addition to 7 parts of a polyether resin identified as Eponol 55-B-40 sold by Miller-Stephenson Chemical Co., and 1.5 weight parts of fumed silica identified as Cab-O-Sil sold by Cabot Corp. The adhesive in the node lines was B-staged at 130° C. for 6.5 minutes. The sheets were arranged in a stack, press cured at 140° C. for 30 minutes and 177° C. for 40 minutes at 50 pounds per square inch to cure the node lines, and the sheets were, then, expanded into a honeycomb. The honeycomb was heat set at 280° C. for 10 minutes. The honeycomb was dipped and cured, repeatedly, in the initially-described epoxy resin solution, but at a solids content of 20%, until a structure having a density of about 0.056 g/cc (3.5 pounds per cubic foot) was obtained. The curing was conducted at 140° C. for 30 minutes and at 177° C. for 40 minutes.

Honeycombs can, also, be made using a phenolic resin solution as the impregnating material. Such honeycombs will have improved resistance to burning and lower cost. An acceptable phenolic resin solution is defined by United States Military Specification MIL-R-9299C.

The Table provides honeycomb shear properties for the several elements of the Example and the Control Comparison.

TABLE

| MPD-I (wt %) | PPD-T (wt %) | Modulus ($kg/cm^2$) | Strength ($kg/cm^2$) |
|---|---|---|---|
| 10 | 90* | 1736 | 17.6 |
| 15 | 85 | 1392 | 15.8 |
| 33 | 67 | 1462 | 16.7 |
| 50 | 50 | 1160 | 15.1 |
| 70 | 30 | 724 | 14.8 |
| Control | Comparison | 599 | 16.7 |

*Altered fabricating process explained below.
**The density of this sample was 0.072 g/cc. The density of the other samples in this Table was 0.056 g/cc.

The honeycomb using paper having only 10% MPD-I was made using solid thermoplastic strips of polyetherimide resin identified as Ultem and sold by General Electric Corp. for adhesion at the node lines because of the difficulty in strike-through when printing paper with so little binder.

The Control Comparison was inadvertently made at a density greater than the density of the examples of the invention. The shear modulus of a honeycomb structure is increased by any increase in density. For that reason, the Control Comparison can stand as an acceptable comparison, because, despite the greater density and consequent expectation of greater shear modulus, it exhibits a substantially lower shear modulus than do any of the honeycombs of the invention.

The honeycomb containing 50, weight, percent or slightly less of para-aramid fiber exhibit acceptably high shear modulus of greater than 1000 $kg/cm^2$. As the fiber content of the honeycomb falls to values of significantly less than 50, weight, percent fiber, shear modulus falls to less than 1000 $kg/cm^2$.

The example demonstrates the superiority of the honeycomb of this invention over the Control Comparison. Papers made from 100% PPD-T would clearly have greatly increased shear modulus and that increase continues with papers having as little as 50% PPD-T. Below 50% para-aramid content, it is expected that the honeycomb shear modulus is only slightly improved over that of the honeycomb of the prior art.

I claim:

1. A honeycomb structure comprising a core impregnated by a solid matrix resin wherein the core comprises:

a) a nonwoven paper including a uniform mixture of
0 to 50, weight, percent polymeric binder material and
50 to 100, weight, percent para-aramid fibers and b) a solid matrix resin uniformly distributed throughout the paper such that the para-aramid fibers represent 20 to 80 percent of the total volume of the impregnated core material and wherein the core exhibits a density of 0.015 to 0.24 g/cc and a shear modulus of greater than 1000 $kg/cm^2$, and wherein the paper, in the absence of matrix resin, has a density corresponding to the following relationship:

$$\text{Paper Density} > \frac{\text{p-aramid fiber density}}{\text{wt. fraction p-aramid fiber}} \times 0.25.$$

2. The honeycomb core of claim 1 wherein the matrix resin is selected from the group consisting of an epoxy resin and a phenolic resin.

3. The honeycomb core of claim 2 wherein the shear modulus of the core is greater than 1000 $kg/cm^2$.

4. The honeycomb structure comprising a core impregnated by a solid matrix resin wherein the core comprises:

a) a nonwoven paper including a uniform mixture of
0 to 50, weight, percent polymeric binder material and
50 to 100, weight, percent para-aramid fibers and b) a solid matrix resin uniformly distributed throughout the paper such that the para-aramid fibers represent 20 to 80 percent of the total volume of the impregnated core material and wherein the core exhibits a shear modulus in accordance with the following relationship:

$$\text{Shear Modulus } (kg/cm^2) > 7000 \times \text{core density } (g/cm^3),$$

and wherein the paper, in the absence of matrix resin, has a density corresponding to the following relationship:

$$\text{Paper Density} > \frac{\text{p-aramid fiber density}}{\text{wt. fraction p-aramid fiber}} \times 0.25.$$

5. The honeycomb core of claim 4 wherein the matrix resin is selected from the group consisting of an epoxy resin and a phenolic resin.

6. The honeycomb core of claim 5 wherein the shear modulus of the core is greater than 1000 $kg/cm^2$.

7. A honeycomb structure comprising a core with hexagonal cells impregnated by a solid matrix resin wherein the core comprises:

a) a nonwoven paper including a uniform mixture of
0 to 50, weight, percent polymeric binder material and
50 to 100, weight, percent para-aramid fibers and b) a solid matrix resin uniformly distributed throughout the paper such that the para-aramid fibers represent 20 to 80 percent of the total volume of the impregnated core material and wherein the core exhibits a shear modulus in accordance with the following relationship:

$$\text{Shear Modulus } (kg/cm^2) > 7000 \times \text{core density } (g/cm^3),$$

and wherein the paper, in the absence of matrix resin, has a density corresponding to the following relationship:

$$\text{Paper Density} > \frac{\text{p-aramid fiber density}}{\text{wt. fraction p-aramid fiber}} \times 0.25.$$

8. The honeycomb core of claim 7 wherein the matrix resin is selected from the group consisting of an epoxy resin and a phenolic resin.

9. The honeycomb core of claim 8 wherein the shear modulus of the core is greater than 1000 $kg/cm^2$.

10. A honeycomb structure comprising a core impregnated by a solid matrix resin wherein the core comprises:

a) a nonwoven paper including a uniform mixture of
0 to 50, weight, percent polymeric binder material and
50 to 100, weight, percent para-aramid fibers and b) a solid matrix resin uniformly distributed throughout the paper such that the para-aramid fibers represent 20 to 80 percent of the total volume of the impregnated core material and wherein the core exhibits a density of 0.015 to 0.24 g/cc and a shear modulus of greater than 1000 kg/cm$^2$, and wherein the paper, in the absence of matrix resin, has a density corresponding to the following relationship:

$$\text{Paper Density} > \frac{\text{p-aramid fiber density}}{\text{wt. fraction p-aramid fiber}} \times 0.25.$$

11. A honeycomb structure comprising a core impregnated by a solid matrix resin wherein the core comprises:

a) a nonwoven paper including a uniform mixture of 0 to 50, weight, percent MPD-I fibrids and 50 to 100, weight, percent PPD-T fibers and b) a solid matrix resin uniformly distributed throughout the paper such that the para-aramid fibers represent 20 to 80 percent of the total volume of the impregnated core material and wherein the core exhibits a density of 0.015 to 0.24 g/cc and a shear modulus of greater than 1000 kg/cm$^2$, and wherein the paper, in the absence of matrix resin, has a density corresponding to the following relationship:

$$\text{Paper Density} > \frac{\text{p-aramid fiber density}}{\text{wt. fraction p-aramid fiber}} \times 0.25.$$

* * * * *

UNITED STATES PATENT AND TRADEMARK OFFICE

CERTIFICATE OF CORRECTION

PATENT NO. : 5,137,768

DATED : August 11, 1992

INVENTOR(S) : Pui-Yan Lin

It is certified that error appears in the above-identified patent and that said Letters Patent is hereby corrected as shown below:

Claim 7, Column 8, line 45, delete "7000" and substitute --14000--.

Claim 10, Column 8, line 64, delete "polymeric binder material" and substitute --MPD-I fibrids-- therefor.

Signed and Sealed this

Twenty-fourth Day of August, 1993

Bruce Lehman

*Attest:*

BRUCE LEHMAN

*Attesting Officer*

*Commissioner of Patents and Trademarks*